US006835227B2

(12) United States Patent
Lian et al.

(10) Patent No.: US 6,835,227 B2
(45) Date of Patent: Dec. 28, 2004

(54) PROCESS FOR MANUFACTURING ALLOY POWDER WITH DUAL CONSUMABLE ROTARY ELECTRODES ARC MELTING

(75) Inventors: Shuang-Shii Lian, Taipei (TW); Ming Lung Shih, Taipei (TW)

(73) Assignee: National Taiwan University, Taipei (TW)

( * ) Notice: Subject to any disclaimer, the term of this patent is extended or adjusted under 35 U.S.C. 154(b) by 138 days.

(21) Appl. No.: 10/387,502

(22) Filed: Mar. 14, 2003

(65) Prior Publication Data

US 2004/0103754 A1 Jun. 3, 2004

(30) Foreign Application Priority Data

Dec. 2, 2002 (TW) ..... 91134941 A

(51) Int. Cl.[7] ..... C22C 1/04

(52) U.S. Cl. ..... 75/351; 75/352; 420/590

(58) Field of Search ..... 75/351, 352; 420/590

(56) References Cited

FOREIGN PATENT DOCUMENTS

JP 5-230508 * 9/1993

* cited by examiner

*Primary Examiner*—Melvyn Andrews
(74) *Attorney, Agent, or Firm*—Rabin & Berdo, P.C.

(57) ABSTRACT

A process for manufacturing alloy powder with dual consumable rotary electrodes arc melting is suitable for manufacturing pure and low-surface-area powder of metal, active metals and their alloys. In the process, rotary electrode and tungsten electrode adopted by conventional rotary electrode and arc process for manufacturing powder are respectively replaced with a rotary or anodic electrode containing a first metal and a feed or cathodic electrode containing a second metal. An inert gas is supplied into equipment for implementing the process to serve as a protective atmosphere and stabilize generated electric arc. The cathodic electrode melts under the high temperature of the arc at a cathodic spot, and droplets of the molten cathodic or second metal are sprayed toward the anodic electrode to mix with molten anodic or first metal and thrown-out by a centrifugal force of the rotary electrode to produce round-shaped alloy powder containing the first and the second metal.

10 Claims, 2 Drawing Sheets

PROCESS FOR MANUFACTURING ALLOY POWDER WITH DUAL CONSUMABLE ROTARY ELECTRODES ARC MELTING

FIELD OF THE INVENTION

The present invention relates to a powder metallurgic process, and more particularly to a process for manufacturing alloy powder with dual consumable rotary electrodes arc melting.

BACKGROUND OF THE INVENTION

Since powder metallurgy provides a lot of advantages, it has been widely employed in making not only various products for use in daily life, but also highly advanced scientific and military items. For example, Titanium (Ti) FeAl and TiAl, which is an intermetallic compound, have good high-temperature strength and low density and are therefore very suitable for applications in high-temperature parts for aerospace industry. Currently, there are many ways for manufacturing powder, such as, for example, Gas atomization, water atomization process, chemical reduction process, centrifugal process, mechanical process, electrolytic process, and chemical decomposition process. Among these processes, Gas atomization, water atomization process, mechanical process, and centrifugal process are more suitable for manufacturing alloys powder.

In the Gas atomization process, an amount of gas is supplied into a liquid metal to stir and splash the latter. Refractory material contained in crucible, lead-in tube, or nozzle used in the process tends to dissolve in the liquid metal to contaminate resultant powder. In the water atomization process, an amount of high-pressure water is applied to a liquid metal to atomize the latter. A main drawback of the water atomization process is the water contains high amount of oxygen that tends to react with the metal and produces oxides, besides the content of hydrogen of produced powder is high. Another drawback of the water spray process is it forms powder having relatively irregular shapes and large surface areas, and products sintered from such powder have less compact structure. In addition, the water spray process also has the same problem of contamination of liquid metal and resultant powder by refractory material of crucible, lead-in tube, or nozzle dissolved in the liquid metal. In the general mechanical process, since the produced powder tends to be contaminated by materials forming the liner of machine and the grinding balls, precision contamination-control equipment is required, which undesirably increases the manufacturing cost of the process. For this reason, the mechanical process and rotary electrode arc melting process are normally employed only to manufacture expensive special powder.

A conventional rotary electrode arc melting process has much lower batch productivity as compared to the Gas atomization process and the water atomization process. However, the rotary electrode arc melting process is not subjected to contamination and produces powder within narrow range of powder size. Therefore, this process is highly useful in producing pure clean and round-shaped metal or alloys powder having low surface area to meet the requirement of special powder needed by aerospace industry. In manufacturing alloy powder with the conventional rotary electrode process, it is necessary to pre-melt the alloy and form alloy ingot through pouring practice. The alloy ingot is then formed and machined to produce an electrode. Moreover, tungsten is used as a non-consumable cathode to manufacture powder in the conventional rotary electrode process, and additional works are needed to pre-melt tungsten alloy and form ingots through pouring. It is particularly difficult to produce small-size electrode bars through pouring and the resultant electrode bars tend to have pouring defects. Moreover, the machining of electrode bars made of high hardness and high strength alloy materials tends to caused damaged machining tools. Therefore, omission of the pre-melting step from the conventional rotary electrode process would be helpful in reducing the manufacturing cost and time needed to obtain the alloy powder.

SUMMARY OF THE INVENTION

It is therefore a primary object of the present invention to overcome the drawbacks existed in the conventional powder metallurgical processes by providing an improved process for manufacturing powder with rotary electrode and electric arc, in which the step of pre-melting electrode bar as included in the conventional rotary electrode process is omitted.

In the process of the present invention, rotary electrode and tungsten electrode adopted by a conventional rotary electrode and arc process for manufacturing powder are respectively replaced with a rotary or anodic electrode containing a first metal and a feed or cathodic electrode containing a second metal. An inert gas, such as argon, helium, etc., is supplied into equipment for implementing the process to serve as a protective atmosphere and to stabilize a generated electric arc. The equipment has a working voltage within the range from 10 to 90 volts, and preferably within the range from 40 to 70 volts, and a working current within the range from 100 to 1500 A, preferably within the range from 300 to 800 A. Through control of different parameters, including the working current, the working voltage, a distance between the two electrodes, etc., melting rates of the two electrodes may be changed. After the electric arc is generated, the cathodic electrode melts under the high temperature of the arc at a cathodic spot, and droplets of the molten cathodic or second metal are under effects of push force formed by plasma arc flow, electromagnetic acting force, arc force, etc., to spray toward the anodic electrode and mix with molten anodic or first metal. A molten mixture of the first and the second metal is thrown out by a centrifugal force produced by the rotary electrode to form round-shaped alloy powder containing the first and the second metal. According to the process of the present invention, the structure of the alloy powder to be obtained may be decided through change of the melting rates of the two electrodes.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
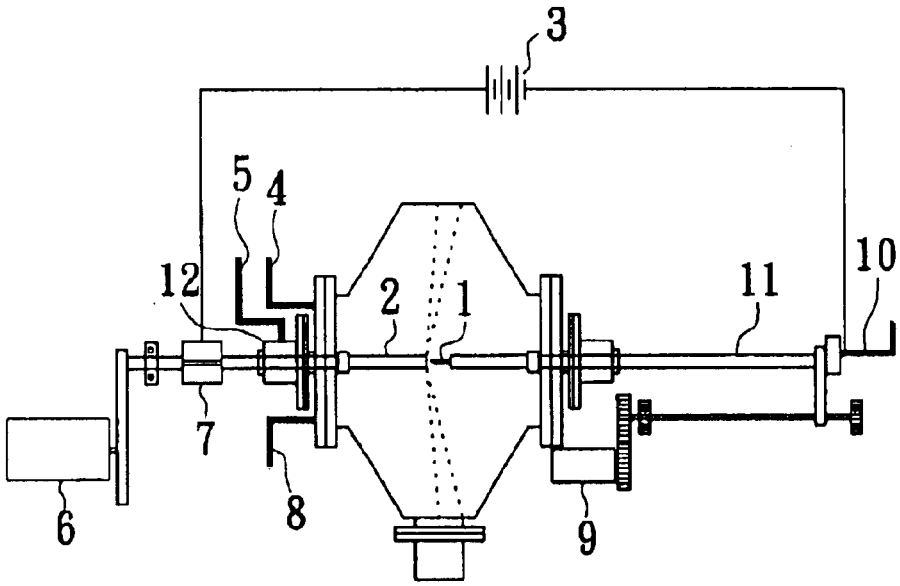
FIG. 1 is a schematic view showing equipment for implementing a rotary electrode spray process for manufacturing alloy powder.

Please refer to FIG. 1 that is an overall view of equipment for implementing a rotary electrode arc melting process for manufacturing alloy powder according to the present invention. In the equipment, there is included a feed metal electrode 1, which replaces the conventional tungsten electrode, a rotary electrode unit 2, a 1500 A power supply 3, a relief valve 4, a first cooling water supply 5, a three-phase alternating motor 6, a carbon brush 7, a vacuum pump 8, a feed motor 9, a second cooling water supply 10, a feed electrode unit 11, and a ferrofluidic seal 12.

Figure 2:
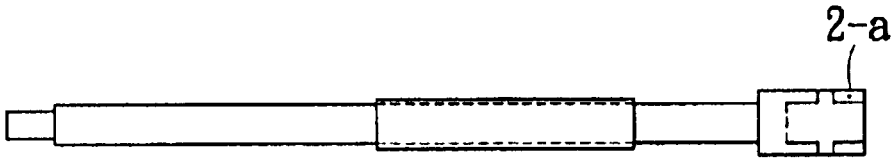
FIG. 2 shows a rotary electrode included in the equipment of FIG. 1.

Please refer to FIG. 2. The rotary electrode unit 2 is provided at a front end with a fixture 2*a* for clamping a rotary electrode (not shown) thereto.

Figure 3:
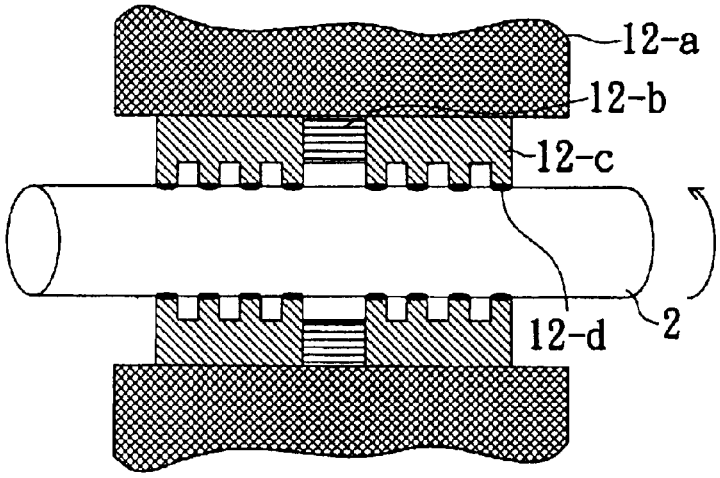
FIG. 3 is a cross sectional view showing a ferrofluidic seal included in the equipment of FIG. 1.

FIG. 3 is a cross sectional view showing the ferrofluidic seal 12. As shown, the ferrofluidic seal 12 includes a wall portion 12*a* defining a cavity therein, a magnet 12*b* and two pole pieces 12*c* mounted in the cavity defined by the wall portion 12*a*, and ferrofluid 12*d* located around the rotary electrode 2.

Figure 4:
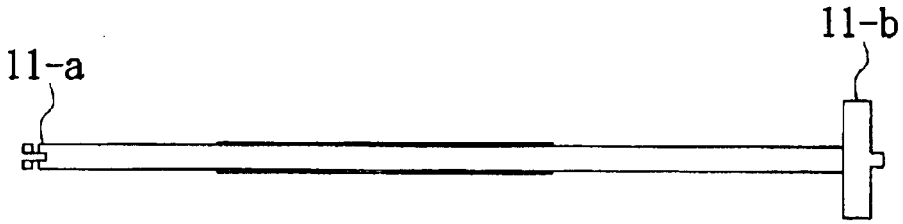
FIG. 4 shows a feed electrode included in the equipment of FIG. 1.

FIG. 4 shows the feed electrode unit 11 includes a feed electrode fixture 11*a* and a cooling water passage 11*b* provided at front and rear ends thereof, respectively.

When using the above-described equipment to implement the process of the present invention, first fix an anodic metal (not shown) to the fixture 2*a* on the rotary electrode unit 2. The anodic metal, that is, the rotary electrode, has a diameter within the range from 10 to 100 mm, and preferably within the range from 40 to 60 mm. And then, fix a cathodic metal (not shown) to the fixture 11*a* on the feed electrode unit 11. Thereafter, a manufacturing chamber of the equipment is repeatedly vacuumized and filled with an inert gas several times to decrease oxygen ($O_2$), nitrogen ($N_2$), and water ($H_2O$) existing in the manufacturing chamber, and the three-phase alternating motor 6 and power supply 3 are actuated. When the motor 6 reaches at a fixed rotating speed, the feed motor 9 is actuated to drive the feed electrode unit 11. When there is electric arc generated, the cathodic metal is subjected to a high temperature of the arc at a cathodic spot and melts. Under effects of push force formed by plasma arc flow, electromagnetic contraction, arc force, etc., droplets of the molten cathodic metal are sprayed toward the anode and mix with molten anodic metal. The molten mixture is thrown out by a centrifugal force generated by the rotary electrode to form round-shaped alloy powder, which falls into a collector (not shown) located below the manufacturing chamber. In the above-described process, the rotary electrode is rotated at a speed within the range from 500 to 10,000 rpm, and is preferably rotated at a speed within the range from 6,000 to 9,000 rpm; and the feed electrode is fed at a speed within the range from 5 to 100 mm/min.

In brief, the present invention is a process for manufacturing alloy powder with dual consumable rotary electrodes arc melting, and may be used to manufacture various kinds of alloys and active alloys, including silicon (Si), titanium (Ti), zirconium (Zr), molybdenum (Mo), chromium (Cr), manganese (Mn), aluminum (Al), magnesium (Mg), rare earth metals, and iron (Fe), and their alloys. Experimental operations have been conducted with the above-described process according to the preferred embodiment of the present invention, and the process has been proven able to achieve the object of the present invention.

The present invention has been described with a preferred embodiment thereof and it is understood that many changes and modifications in the described embodiment can be carried out without departing from the scope and the spirit of the invention as defined by the appended claims.

What is claimed is:

1. A process for manufacturing alloy powder with dual consumable rotary electrodes arc melting, in which equipment for a conventional rotary electrode arc melting process for manufacturing alloy powder is employed to manufacture an alloy powder containing a first and a second metal, said equipment including a three-phase motor, a power supply, and a feed motor, and having a manufacturing chamber; said process comprising the following steps:

providing a rotary electrode containing said first metal to serve as an anode, and a feed electrode containing said second metal to serve as a cathode;

locating said rotary electrode and said feed electrode at predetermined positions in said manufacturing chamber;

vacuumizing said manufacturing chamber and supplying a protective gas thereinto; and actuating said three-phase motor and said power supply, and actuating said feed motor to drive said feed electrode when said three-phase motor reaches at a predetermined rotating speed;

said process being characterized in that an electric arc is utilized to melt said second metal contained in said cathode and said first metal contained in said anode, so that said first and second metals in molten state are mixed with each other and atomized to produce alloy powder; and that said feed electrode may be provided with an increased feed speed or an increased diameter to produce alloy powder having predetermined alloy compositions; and that said rotary electrode may be provided with an increased rotating speed or an increased diameter to centrifugally atomize a molten mixture of said first and second metals into the finest possible alloy powder.

2. The process for manufacturing alloy powder with dual consumable rotary electrodes arc melting as claimed in claim 1, wherein said protective gas is an inert gas.

3. The process for manufacturing alloy powder with dual consumable rotary electrodes arc melting as claimed in claim 2, wherein said inert gas is argon.

4. The process for manufacturing alloy powder with dual self-melting rotary electrodes as claimed in claim 2, wherein said inert gas is helium.

5. The process for manufacturing alloy powder with dual self-melting rotary electrodes as claimed in any one of claims 1, 2, 3, and 4, wherein said equipment is operated at an initial voltage within the range from 10 to 90 volts, and preferably within the range from 40 to 70 volts.

6. The process for manufacturing alloy powder with dual self-melting rotary electrodes as claimed in any one of claims 1, 2, 3, and 4, wherein said equipment is operated with a working current within the range from 100 to 1500 A, and preferably within the range from 300 to 800 A.

7. The process for manufacturing alloy powder with dual self-melting rotary electrodes as claimed in any one of claims 1, 2, 3, and 4, wherein said feed electrode has a diameter within the range from 5 to 20 mm, and preferably within the range from 8 to 15 mm.

8. The process for manufacturing alloy powder with dual self-melting rotary electrodes as claimed in any one of claims 1, 2, 3, and 4, wherein said rotary electrode has a diameter within the range from 10 to 100 mm, and preferably within the range from 40 to 60 mm.

9. The process for manufacturing alloy powder with dual self-melting rotary electrodes as claimed in any one of claims 1, 2, 3, and 4, wherein said rotary electrode is rotated at a speed within the range from 500 to 10,000 rpm, and preferably within the range from 6,000 to 9,000 rpm.

10. The process for manufacturing alloy powder with dual self-melting rotary electrodes as claimed in any one of claims 1, 2, 3, and 4, wherein said feed electrode is fed at a speed within the range from 5 to 100 mm/min.

* * * * *